US005257823A

United States Patent [19]

Colvin, Jr. et al.

[11] Patent Number: 5,257,823

[45] Date of Patent: Nov. 2, 1993

[54] PERSONALIZABLE PAPER PRODUCT AND METHOD

[75] Inventors: Gale L. Colvin, Jr., Medinah; Andrew R. Chomicz; Dawn K. Chomicz, both of Elgin, all of Ill.

[73] Assignee: Papercrafters, Inc.

[21] Appl. No.: 938,405

[22] Filed: Aug. 31, 1992

[51] Int. Cl.[5] ..... B42D 15/00

[52] U.S. Cl. ..... 283/117; 40/124.1; 446/149

[58] Field of Search ..... 283/117; 40/124.1; 446/147, 149, 150

[56] References Cited

U.S. PATENT DOCUMENTS

| | | | |
|---|---|---|---|
| 2,035,218 | 3/1936 | Bloom | 229/71 |
| 2,180,808 | 11/1939 | Jacobstein et al. | 283/6 |
| 2,812,957 | 11/1957 | Sarlund | 283/6 |
| 3,822,901 | 7/1974 | Seidman | 283/6 |
| 3,900,219 | 8/1975 | D'Amato et al. | 283/6 |
| 4,907,827 | 3/1990 | Khazin et al. | 283/65 |
| 5,110,155 | 5/1992 | Piechocki et al. | 283/117 |

FOREIGN PATENT DOCUMENTS

| | | | |
|---|---|---|---|
| 189817 | 8/1986 | European Pat. Off. | 283/117 |
| 220827 | 5/1987 | European Pat. Off. | 283/117 |
| 3530227 | 2/1987 | Fed. Rep. of Germany | 283/117 |

*Primary Examiner*—Mark Rosenbaum
*Assistant Examiner*—Willmon Fridie, Jr.
*Attorney, Agent, or Firm*—Ted K. Ringsred

[57] ABSTRACT

A conveniently personalizable paper product is provided by a piece of folded cardstock paper having one or more die-cut doors in the front half of the paper which, when the paper is folded together, align with designated message areas located on the inside surface of the back half of the paper. A layer of adhesive disposed on the inside surface of the front half of the folded paper around the die-cut doors. A user of the product simply enters information (e.g., writing or photographs) on the designated message areas, moistens the adhesive, and folds the two halves together.

13 Claims, 2 Drawing Sheets

PERSONALIZABLE PAPER PRODUCT AND METHOD

BACKGROUND OF THE INVENTION

The present invention relates to paper articles of the type used for conveying information, such as greeting cards, business cards, invitations, and the like, and more particularly, to a conveniently personalizable paper product having one or more die-cut doors beneath which information can be conveniently entered by the user.

Paper products having die-cut doors overlying pre-printed information are known in the art, as shown, for example, by Jacobstein et al. (U.S. Pat. No. 2,180,808). A typical die-cut door is stamped through the paper in the desired shape, but has small un-cut connections left to hold the door flap in place until it is manually opened by an individual wishing to reveal the underlying information. A larger un-cut portion may also be left to act as a hinge, so that the door flap will remain attached after opening.

Lottery or chance tickets are a common use of paper products having such die-cut doors.

It is also known that envelopes can be made with pre-cut windows for displaying information on a letter placed within the envelope, and that a flap can be fastened over such a window (see Bloom, U.S. Pat. No. 2,035,218).

However, there has not previously been an easily manufactured, simple to use, and conveniently personalizable paper product with die-cut doors which is useful for an extremely wide range of applications. For example, the present invention can be used for personalizable invitations or greeting cards. Likewise, the present invention can be easily and inexpensively used by individual consumers and small orginizations for creating their own chance tickets or lottery-type games without the substantial time and expense of having such items professionally manufactured Accordingly, it is an object of the present invention to provide a personalizable paper product which is inexpensive to manufacture.

It is another object of the invention to provide a paper product having die-cut doors which is simple and intuitive to use without instructions.

A related object is to provide a product which can be quickly and conveniently personalized by the user.

More particularly, it is an object of the present invention to provide a paper product having one or more die-cut doors beneath which the user can place information without disrupting the die-cut doors.

Yet another object of the invention is to provide a polished, professional looking personalizable paper product which entices a reader to view certain information and generates interest in the subject matter of the information.

SUMMARY OF THE INVENTION

These objects, as well as others that will become apparent upon reference to the accompanying drawings and following detailed description, are provided by a paper article having one or more die-cut doors. The paper has a fold line so that the user may conveniently and accurately fold the product together at the proper location. The fold line divides the paper into at least two portions The exterior side of the paper, i.e., the eventual exterior of the finished product after being personalized and folded together by a user, has whatever pre-printed information or design that is desired. The interior side of the paper, i.e., the eventual interior of the finished product, include message areas where personalized information is to be entered. These message areas correspond to those portions of the interior which will be exposed when the die-cut doors of the finished, personalized product are opened. The message areas may be designated by pre-printed patterns to facilitate identification of precisely where the personalized information is to be entered.

Adhesive is disposed on the interior side of the paper so that, after the user has entered any desired information, the paper can be conveniently folded and adhered together. The adhesive is not disposed, however, over either the interior surfaces of the die-cut doors or over the designated message areas, so that when the article is personalized and finished by a user the doors will not be bonded to the interior of the product thereby preventing the doors from being easily opened by a recipient.

Hence, a professional-looking finished paper product with removable doors overlying personalized information can be created by the user quickly and easily. The user can himself or herself place whatever information is desired beneath the doors without disrupting the doors, and thereby gain the delightful effect of a finished product having die-cut doors which are opened to see the hidden information. A recipient of the product will be intrigued as to what lies beneath the die-cut doors, thereby generating substantial positive interest in the product and its subject matter.

Moreover, because the small un-cut paper connections holding the door will be intact until the door is opened, thus showing that it has not previously been opened or tampered with, a recipient will be somewhat surprised to find personalized information beneath the door, such as a handwritten note or a personal photograph, rather than merely pre-printed information.

This positive effect is further enhanced because the product, after it has been personalized, folded and bonded together by the user, has a polished and professional appearance—looking as though it were manufactured in its final form. Indeed, it often may not be immediately apparent to a viewer of the finished article that it was in fact not professionally finished into final form, thus giving an impression that greater expense and effort was involved than was actually necessary.

To the contrary, however, the present invention is exceptionally quick, easy, and intuitive to use. A user merely places desired information on the designated message areas, moistens the adhesive, and folds the paper together. This contrasts with, for example, envelopes having display windows where it is instantly apparent that any message or other information was simply slipped into the envelope so as to align with the window.

Thus, when personalized and finished by a user, the present invention tends to give a delightful, positive impression to its recipient. This substantially enhances interest in whatever the subject matter is being communicated by the article made according to the present invention.

BRIEF DESCRIPTION OF THE DRAWINGS

In describing the preferred embodiment, reference is made to the accompanying drawings wherein.

DETAILED DESCRIPTION OF THE PREFERRED EMBODIMENT

Figure 1:
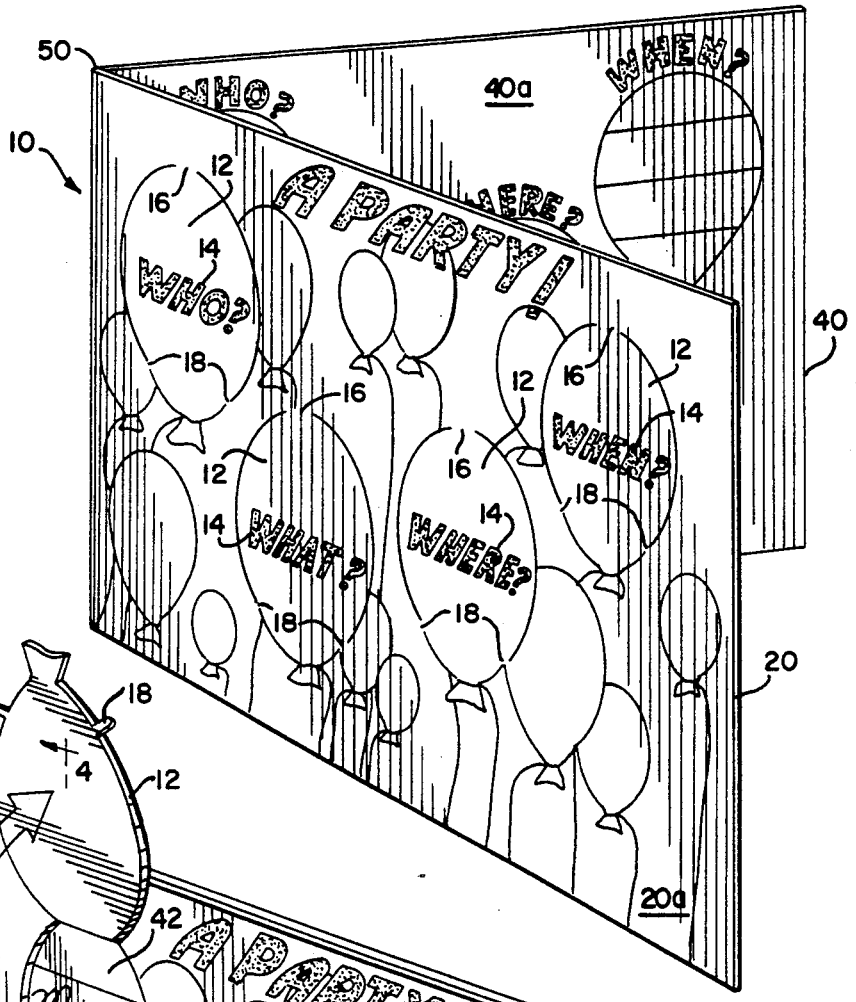
FIG. 1 is a perspective view of a typical paper product made according to the preferred embodiment of the present invention.

Turning to the figures of the drawings, there is seen in FIG. 1 a single-piece paper product 10 made in accordance with the preferred embodiment of the present invention. Paper product 10 is printed, for illustrative purposes only, as a party invitation. While this may be one typical application of the present invention, it is nonetheless intended merely as an example of one of the many potential uses of the invention.

As best seen in FIG. 1, a single piece of cardstock paper, as is well known in the art, is divided by a fold line 50 into two halves, a front half 20 and a back half 40. Preferably, fold line 50 is a crease formed by prefolding the paper, so as to facilitate accurate folding of the product by a user later, after personalization. It will be recognized, however, that any indicator of where the paper is to be folded will suffice under the present invention. For example, a score line could also be used. Moreover, the paper could have more than one fold line, depending on the particular arrangement and design of the product.

Figure 2:
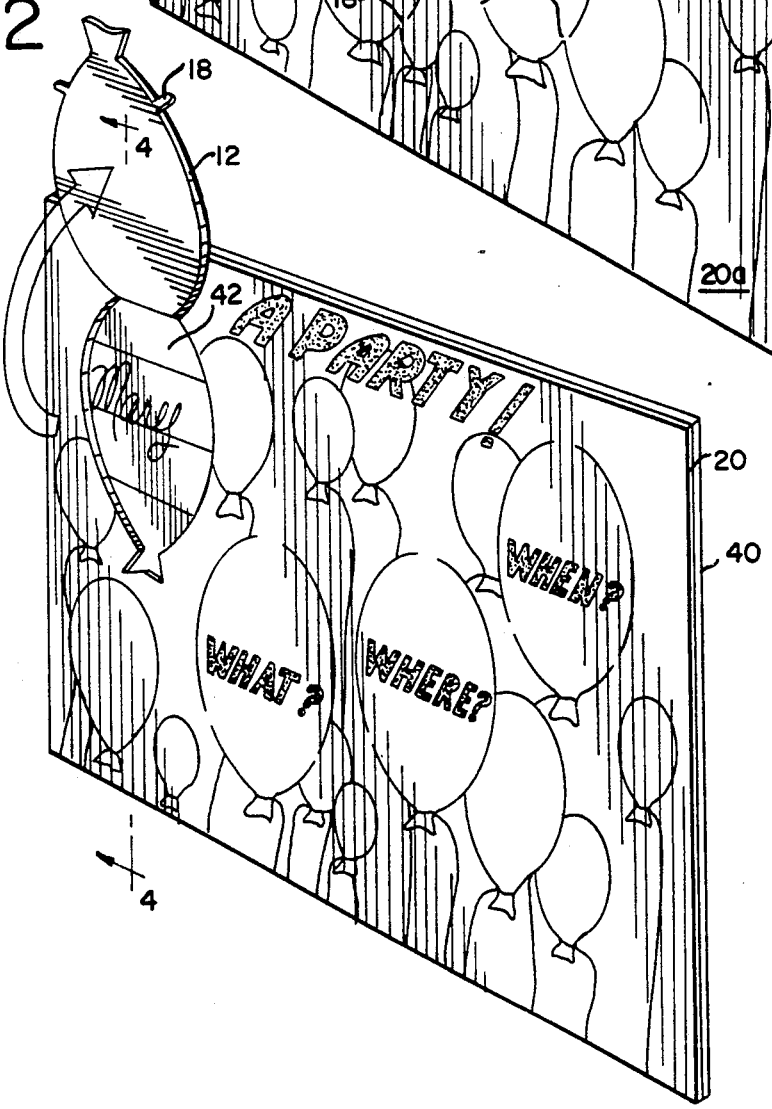
FIG. 2 is a perspective view of the paper product of FIG. 1 after it has been personalized and folded into finished form by a user, and one die-cut door has been opened.
Figure 3:
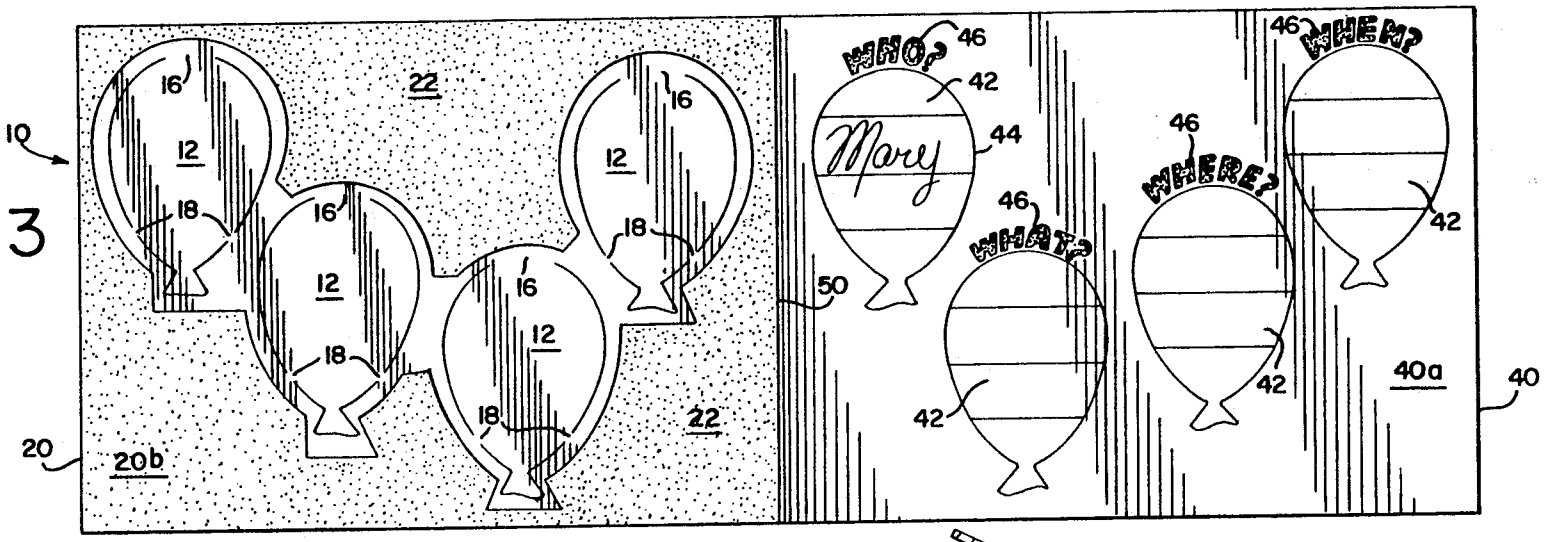
FIG. 3 is a plan view of the paper product unfolded and showing its interior surfaces.

Front half 20 has an exterior surface 20*a* (best seen in FIG. 1) and an interior surface 20*b* (best seen in FIG. 3). Exterior surface 20*a* will result on the exterior of the product after, as described below, it has been personalized and folded together, while interior surface 20*b* will result on the interior of the finished product. Exterior surface 20*a* of the paper product may have a printed design and writing, as best shown in FIGS. 1 and 2. In the present illustrative example, the design is of party balloons, and a written heading exclaims "A PARTY!"

The outlines of four balloon shaped die-cut doors 12 can also be seen on surface 20*a* shown in FIG. 1; each of the four doors in the present example having a label 14—"WHO?", "WHAT?", "WHERE?", and "WHEN?", respectively. The doors 12 are made by die-cutting the paper, as is well known in the art, entirely through front half 20 except for each door preferably having an uncut hinge portion 16 and very small retaining connections 18, as best seen in FIGS. 1 and 3.

As shown in FIG. 3, the interior surface 20*b* of front half 20 has no pre-printed design or information, although the outlines of the die-cut doors 12 are visible. An adhesive layer 22 is preferably disposed generally over the surface of interior surface 20*b*, as best seen in FIG. 3 and as also seen in cross-section FIGS. 4 and 5. Adhesive may, alternatively or in addition to being on surface 20*b*, be disposed over interior surface 40*a*, although not shown in the preferred embodiment. However, no adhesive is disposed on the interior surfaces of the die-cut doors 12.

Adhesive 22 is preferably a water activated adhesive, which is non-sticky when dry, but becomes activated when moistened. However, any adhesive capable of bonding the paper together will be acceptable, such as remoistenable adhesive, pressure sensitive adhesive with a backing, or latex adhesive with or without a backing.

The back half 40 of paper product 10 likewise has an exterior surface (not shown) and an interior surface 40*a*. Interior surface 40*a* includes message areas 42 which are preferably designated by pre-printed outlines 44 or some other means of demarcation. Message areas 42 are positioned such that when the two halves 20 and 40 of paper product 10 are folded together along fold-line 50, the message areas 42 of interior face 40*a* will align with the die-cut windows 12 in front half 20 and thus be visible when the die-cut windows 12 are later opened (as best seen in FIG. 2).

Message area labels 46—in this illustrative example, "WHO?", "WHAT?", "WHERE?", and "WHEN?", respectively—are preferably pre-printed on interior surface 40*a* in association with each message area 42 in order to conveniently indicate to the user what information is to be placed in each designated message area 42. Also, printing, shading, coloring, or the like (not shown) may be used on the areas surrounding the message areas of interior surface 40*a* to more clearly demarcate the proper message areas and help prevent inadvertent misplacement of information outside the message areas 42.

Figure 4:
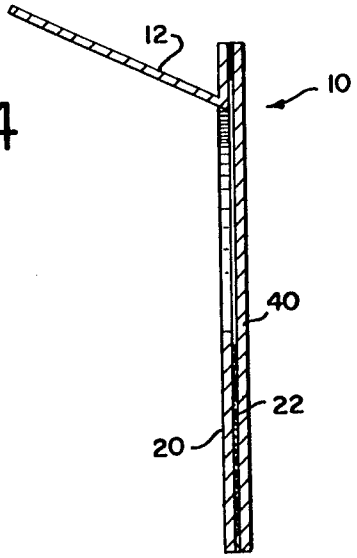
FIG. 4 is a cross-section along line 4—4, before the door has been opened.
Figure 5:
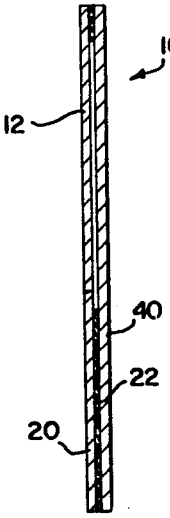
FIG. 5 is a cross-section along line 4—4, after the door has been opened.

A user of the present invention simply enters whatever information is desired on the designated message areas 42. For example, FIG. 4 shows a handwritten entry of the name "Mary." The information may include such things as writings, drawings, or photographs. For example, in the context of the present illustrative embodiment, a photograph of the individual sending the party invitation could be placed in the message area beneath label 43*a*, "WHO?".

After the desired information is entered in the message areas 42, the adhesive 22 disposed on the interior surface 20*b* is activated, typically by moistening it with a sponge or similar method. The adhesive 22 is preferably located on interior surface 20*b* rather than interior surface 40*a* so that the information in message areas 42 will not be smeared or otherwise disturbed when the adhesive is activated. It should be recognized, however, that adhesive could be disposed on surface 40*a*, particularly if activation of the adhesive were not disruptive of messages on the message areas. For example, an adhesive could be used which is not water activated, but which instead has a thin, protective non-stick backing over it which can be peeled off when exposure of the adhesive is desired, as is well known in the art.

After adhesive 22 is moistened, the two halves 20 and 40 of the paper product are folded together along fold 50 so that interior faces 20*b* and 40*a* come into contact with each other. The adhesive 22 securely bonds the two halves 20 and 40 together except at the interface surfaces between the die-cut doors 12 and message areas 42, where no adhesive is present.

The result is a highly professional looking paper product for communicating information—in the present example a party invitation—which is personalized according the user's needs with information hidden beneath openable doors. The product, while having been very simple and convenient to prepare by the user, will have an appearance as though it were professionally manufactured in its finished personalized form.

To expose the personalized information located in message areas 42, a recipient of the finished personalized product simply lifts open the doors 12 (tearing connecting portions 18), as best illustrated in FIG. 2 where one door has been opened and the handwritten name "Mary" is revealed underneath.

From the foregoing, it can be seen that a conveniently personalizable paper product with die-cut doors has been provided which fully meets the objects of the instant invention. While the article has been described in the terms of a preferred embodiment, there is no intent to limit the invention to the same. On the contrary, it is intended to cover all modifications and equivalents within the scope of the appended claims. It should be emphasized that many variations of the present invention will be apparent to one skilled in the art.

What is claimed is:

1. A personalizable paper article, comprising:

a piece of paper including a fold line separating said paper into first and second portions, said first and second portions of the paper each having an exterior and an interior surface;

at least one die-cut door located in said first portion of the paper;

a message area located on the interior surface of said second portion of the paper where a user of the product is to enter desired information;

said message area located such that when the piece of paper is folded together along said fold line the message area will be aligned with said die-cut door such that information entered in said message area will be visible through said door when said door is opened; and adhesive disposed on an interior surface of said paper on areas surrounding said die-cut door and said designated message area.

2. The paper article of claim 1, wherein there are a plurality of die-cut doors and corresponding message areas.

3. The paper article of claim 2, wherein said message areas each include an associated label indicating what type of information is to be entered in the particular message area.

4. The paper article of claim 1, wherein the exterior surface of said first portion of the paper includes a label associated with said die-cut door indicating what type of information is to be found beneath the door.

5. The paper article of claim 1, wherein said die-cut door includes an uncut hinge portion which maintains attachment of the door after opening.

6. The paper article of claim 1, wherein said die-cut door includes a small uncut connection which retains the door until it is manually opened.

7. The paper article of claim 1, wherein said adhesive is applied to the interior surface of said first portion of the paper.

8. The paper article of claim 1, wherein said adhesive is a water activated adhesive.

9. The paper article of claim 1, wherein said message area is demarcated by a pre-printed outline corresponding to the outline of the die-cut door.

10. The paper article of claim 1, wherein said fold line comprises a crease formed by pre-folding the paper.

11. The paper article of claim 1, wherein said fold line comprises a scored line to facilitate folding of the paper.

12. A personalizable paper article having die-cut doors, which can be conveniently personalized with information by a user and then formed into a unitary final product such that the personalized information will appear beneath the die-cut doors when the doors are lifted, comprising:

a single piece of cardstock paper having a fold-line formed by a crease dividing the paper into two halves, a first half and a second half, said first and second halves each including an interior and an exterior surface;

said first half of said paper including a plurality of die-cut doors, said doors including an uncut hinge portion and a plurality of small uncut connecting portions, each of said plurality of die-cut doors including a label identifying the nature of the information to be located beneath the door;

a plurality of designated message areas on said interior surface of said second half of said paper, one message area corresponding to each die-cut door, said designated message areas demarcated by a pre-printed outline of the same shape as its corresponding die-cut door, said designated message areas located such that when said first and second halves of said paper are folded together said message area align with said die-cut doors;

a plurality of message area labels pre-printed on said interior surface of said second half of said paper in association with said designated message areas; and water activated adhesive disposed over substantially the entire interior surface of said first half of said paper surrounding said die-cut doors.

13. A method of finishing a personalizable paper product comprising a single-piece paper article including first and second portions separated by a fold line, said first and second portions each including an exterior and an interior surface, said first portion including one or more die-cut doors, said interior surface of said second portion of said paper including one or more designated message areas corresponding to each die-cut door, and one of said interior surfaces including a layer of adhesive, comprising the steps of:

applying information to said one or more designated message areas;

activating said adhesive;

folding said first and second paper portions together along said fold line such that said adhesive bonds said interior surfaces together and said designated message areas align with said one or more die-cut doors such that information entered in said message areas will be visible when said doors are opened.

* * * * *